US010359222B2

(12) United States Patent
Izadi-Zamanabad et al.

(10) Patent No.: US 10,359,222 B2
(45) Date of Patent: Jul. 23, 2019

(54) CONTROLLER FOR A VAPOUR COMPRESSION SYSTEM AND A METHOD FOR CONTROLLING A VAPOUR COMPRESSION SYSTEM

(71) Applicant: Danfoss A/S, Nordborg (DK)

(72) Inventors: Roozbeh Izadi-Zamanabad, Soenderborg (DK); Harald Alnor, Aabenraa (DK)

(73) Assignee: Danfoss A/S, Nordborg (DK)

( * ) Notice: Subject to any disclaimer, the term of this patent is extended or adjusted under 35 U.S.C. 154(b) by 616 days.

(21) Appl. No.: 14/391,428

(22) PCT Filed: Mar. 19, 2013

(86) PCT No.: PCT/DK2013/000023
§ 371 (c)(1),
(2) Date: Oct. 9, 2014

(87) PCT Pub. No.: WO2013/167027
PCT Pub. Date: Oct. 24, 2013

(65) Prior Publication Data

US 2015/0107282 A1 Apr. 23, 2015

(30) Foreign Application Priority Data

Apr. 17, 2012 (DK) ..... 2012 00265

(51) Int. Cl.
*F25B 49/02* (2006.01)
*F25B 41/06* (2006.01)
*F25B 41/04* (2006.01)

(52) U.S. Cl.
CPC ..... *F25B 49/02* (2013.01); *F25B 41/043* (2013.01); *F25B 41/062* (2013.01); (Continued)

(58) Field of Classification Search
CPC ..... F25B 2600/2513; F25B 2700/2104; F25B 2700/21175; F25B 2700/21151
See application file for complete search history.

(56) References Cited

U.S. PATENT DOCUMENTS 4,478,051 A * 10/1984 Ibrahim ..... F25B 41/062 165/279
4,506,518 A * 3/1985 Yoshikawa ..... F24F 11/0009 251/129.11

(Continued)

FOREIGN PATENT DOCUMENTS

CN 1486414 A 3/2004
CN 1512284 A 7/2004

(Continued)

OTHER PUBLICATIONS

JP 2005-207722 (English Translation).*

(Continued)

*Primary Examiner* — Jonathan Bradford
(74) *Attorney, Agent, or Firm* — McCormick, Paulding & Huber LLP

(57) ABSTRACT

The invention discloses a controller for a vapor compression system for cooling a refrigerated space. The system comprises a circuit for circulation of a refrigerant between a compressor, a condenser, and an evaporator. An expansion valve controls a flow of the refrigerant into the evaporator and thereby cooling of the refrigerated space. The control system is adapted to control the expansion valve based on a first temperature in the circuit between the evaporator and the compressor and a second temperature determined in the refrigerated space.

10 Claims, 5 Drawing Sheets

(52) U.S. Cl.
CPC ... *F25B 2600/01* (2013.01); *F25B 2600/2513* (2013.01); *F25B 2700/2104* (2013.01); *F25B 2700/21151* (2013.01); *F25B 2700/21173* (2013.01)

(56) References Cited

U.S. PATENT DOCUMENTS

| | | | | |
|---|---|---|---|---|
| 5,123,255 | A * | 6/1992 | Ohizumi | F24F 11/0009 165/205 |
| 5,157,934 | A | 10/1992 | Uchida | |
| 5,255,529 | A | 10/1993 | Powell et al. | |
| 5,392,612 | A * | 2/1995 | Alsenz | F25B 41/062 62/115 |
| 5,396,779 | A | 3/1995 | Voss | |
| 7,290,402 | B1 * | 11/2007 | Bailey | F25B 41/062 236/92 B |
| 2004/0068999 | A1 | 4/2004 | Jessen | |
| 2006/0086111 | A1 * | 4/2006 | Kang | F24F 11/008 62/176.6 |
| 2009/0241566 | A1 * | 10/2009 | Bush | F25B 9/008 62/115 |
| 2010/0174412 | A1 * | 7/2010 | Kwon | F24F 11/0009 700/275 |
| 2013/0002446 | A1 * | 1/2013 | Smith | F25B 49/005 340/815.4 |

FOREIGN PATENT DOCUMENTS

| | | | |
|---|---|---|---|
| CN | 101266082 | A | 9/2008 |
| CN | 101460790 | A | 6/2009 |
| EP | 0 651 213 | A1 | 5/1995 |
| JP | 2008241072 | A | 10/2008 |
| WO | WO2007/139554 | A1 | 12/2007 |

OTHER PUBLICATIONS

Danish Search Report Serial No. PA201200265 dated Nov. 7, 2012.
International Search Report for PCT Serial No. PCT/DK2013/000023 dated Aug. 6, 2013.

* cited by examiner

CONTROLLER FOR A VAPOUR COMPRESSION SYSTEM AND A METHOD FOR CONTROLLING A VAPOUR COMPRESSION SYSTEM

CROSS-REFERENCE TO RELATED APPLICATION

This application is entitled to the benefit of and incorporates by reference subject matter disclosed in International Patent Application No. PCT/DK2013/000023 filed on Mar. 19, 2013 and Danish Patent Application PA 2012 00265 filed Apr. 17, 2012.

FIELD OF THE INVENTION

The present invention relates to a controller for a vapour compression system for cooling a refrigerated space. The system comprises a circuit for circulation of a refrigerant between a compressor, a condenser, and an evaporator. An expansion valve is provided to control a flow of the refrigerant into the evaporator and thereby cooling of the refrigerated space.

BACKGROUND

Vapour compression systems, such as refrigeration systems, air condition systems or heat pumps, normally comprise a compressor, a condenser, an expansion device, and an evaporator arranged in a refrigerant circuit. Refrigerant is circulated in the refrigerant circuit and is alternatingly expanded and compressed, and heat exchange takes place in the condenser and the evaporator. Expanded refrigerant enters the evaporator in a mixed state of gaseous and liquid refrigerant. As the refrigerant passes through the evaporator, it evaporates while exchanging heat with a secondary fluid flow, such as an air flow, across the evaporator. In order to utilise the potential refrigerating capacity of the evaporator to a maximum extend, it is desirable that liquid refrigerant is present along the entire length of the evaporator. On the other hand, it is undesirable that liquid refrigerant passes through the evaporator and into the suction line, since it may cause damage to the compressor if liquid refrigerant reaches the compressor. It is therefore desirable to control the supply of refrigerant to the evaporator in such a manner that the compressor is not damaged while at the same time utilising the full capacity of the evaporator.

In order to obtain this, a pressure sensor is typically used to measure a pressure to derive an evaporation temperature of the refrigerant and a temperature sensor to measure the outlet temperature of the refrigerant leaving the evaporator. Traditionally, the expansion valve is controlled based on a temperature difference between this evaporation temperature and the outlet temperature at the pressure in question.

Thus, it is necessary to use a pressure sensor in the above-described control. As such a pressure sensor may fall out or malfunction, it may be impossible to derive at an evaporation temperature, which may further prevent control of the supply of refrigerant to the evaporator until the pressure sensor is restored.

US 2004/0068999 discloses a controller for an expansion valve of a refrigeration system. Sensors may register various selected temperatures and pressures of the cooled medium and refrigerant at different positions in the refrigeration system. The measured pressures and temperatures are used in the controller for controlling the injection of refrigerant into the evaporator in order to maintain stable operation conditions.

SUMMARY

It is an object of embodiments of the invention to provide a controller for controlling a vapour compression system, and a method of controlling such a system.

It is a further object of embodiments of the invention to provide a controller which allows controlled cooling and thus a more energy efficient cooling, and a method of controlling such a system.

It is an even further object of embodiments of the invention to provide a controller enable omission of a pressure sensor from a vapour compression system, and a method of controlling such a system.

According to a first aspect, the invention provides a controller for a vapour compression system for cooling a refrigerated space, the system comprising a circuit for circulation of a refrigerant between a compressor, a condenser, and an evaporator, and an expansion valve controlling a flow of the refrigerant into the evaporator and thereby cooling of the refrigerated space characterized in that the controller is adapted to control the expansion valve based on a first temperature in the circuit between the evaporator and the compressor and a second air temperature determined in the refrigerated space.

In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

By the specification of the controller being adapted to control the expansion valve based on temperatures determined at different locations, it is herein meant that the controller is adapted to communicate with sensors arranged in the circuit and in the refrigerated space and to use readings from these sensors to control the expansion valve, and thus determine an opening degree hereof.

The controller may comprise a data input, e.g. reading from a data-bus, a stream of data obtained from a number of independent temperature sensors arranged in the refrigerated space and in the circuit after the evaporator. The controller may also have individual data ports for reading the sensor input.

The sensors could be traditional temperature sensors of the kind typically used in traditional refrigerators, air conditioning system, heat pump, or freezers.

The first temperature is determined between the evaporator and the compressor. It may be the temperature of the refrigerant when leaving the evaporator, i.e. the first temperature may be measured at the evaporator outlet.

The second air temperature is determined in the refrigerated space. Thus, the second temperature may be determined as the temperature of the second medium after having passed the evaporator, where heat is exchanged with the refrigerant.

The second temperature may be measured in the refrigerated space. As an alternative, the controller may be adapted to estimate the second temperature based on a temperature difference between a third air temperature and a preselected offset value. The third temperature may be measured in a stream of air before the evaporator, and the preselected offset value may be set in the controller.

Based on these two temperatures, the controller is adapted to control the expansion valve, and the controller may thus control opening and closing of the valve based hereon.

One advantage of such a controller is that a pressure sensor is not needed, thereby saving the costs of a pressure sensor. Furthermore, installation work may be easier. However, the controller may also be used in vapour compression system incorporating a pressure sensor. In such cases, the controller may be used as back-up by appling a control strategy based on the first and second temperatures if the pressure sensor fails.

The controller may be adapted to control the expansion valve in order to obtain a selected target temperature in the refrigerated space. When the target temperature is reached, the controller may be adapted to close the expansion valve and thereby stop circulation of refrigerant. However, a temperature being lower than the target temperature may also be used as a closing temperature for the expansion valve.

In order to assure, that the temperature in refrigerated space does not exceed the target temperature, the controller may be adapted to initialise control of the expansion valve based on an air temperature determined in the refrigerated space. This air temperature may be equal to the target temperature, or may be chosen relative to the target temperature to ensure that the target temperature is not exceeded. Consequently, this initialising air temperature may be selected e.g. based on the size of the refrigerated space, the position of the sensor for determining the air temperature, the sensitivity of the items to be kept in the refrigerated space, etc.

As the first temperature is a temperature of the refrigerant determined between the evaporator and the compressor and the second temperature is determined in the refrigerated space, the controller may be adapted to control the valve based on a difference between the first and second temperatures, as the difference between the first and second temperatures may be seen as an expression of the cooling need.

When the expansion valve has been closed for a while, e.g. a few minutes, the first temperature may become higher than the second temperature. This may happen as the refrigerant may be warmed by the air faster than the second temperature changes as a residual of refrigerant in the evaporator may cool down the air. Thus, the first temperature may change faster than the second temperature, whereby the first temperature may become higher than the second temperature. To lower the first temperature the expansion valve will have to be opened, and in order to achieve this, the controller may be adapted to open the valve, if the first temperature is higher than the second temperature.

In order to avoid that the expansion valve is continuously opened and closed at very short intervals, the controller may be adapted to close the valve, if a difference between the first and second temperatures is above a predefined closing value. The predefined closing value may be seen as a hysteresis ensuring that the expansion valve is not continuously opened and closed at very short intervals.

In an alternative embodiment, the valve may be opened, if a difference between the first and second temperatures is above a predefined opening value. The predefined opening value may thus be seen as a hysteresis ensuring that the expansion valve is not continuously opened and closed at very short intervals. Furthermore, the valve may be closed, if the first temperature is lower than the second temperature.

As a further alternative, the control strategy may incorporate the rate of change, Roc, of the first and second temperatures T1 and T2, where the Rate of change, Roc, is positive if the temperatures are increasing and negative if the temperatures are decreasing.

In one embodiment, the expansion valve may be opened, if the rate of change, Roc, of both the first and second temperature T1 an T2 is positive, and if the first temperature T1 is higher than T1.0 plus a predefined opening constant, where T1.0 is defined as the value of the first temperature T1 when previously closing the expansion valve.

The expansion valve may correspondingly be closed, if the rate of change, Roc, of both the first and second temperature T1 an T2 is negative, and if the first temperature T1 is lower than the second temperature T2 minus a predefined closing constant.

During start-up of the vapour compression system, the first and second temperature may be equal or at least with a small range, as no refrigerant has been circulated. Thus, it may be an advantage if the valve is fully opened during start-up to ensure sufficient cooling of the refrigerated space. It may likewise be an advantage to fully open the valve after a longer time period in which it has been closed, as the first and second temperature may be equal or at least with a small range after such a time period.

Thus, the controller may be adapted to control the expansion valve based on information about the duration of in which the valve is open. The controller may store information about this duration during control of the expansion valve. Alternatively, the duration may be monitored by a separate monitoring unit being adapted to determine the opening time of the expansion valve. The controller may be adapted to control the expansion valve by changing the degree of opening of the valve based on the duration.

Consequently, the opening degree of the expansion valve may be increased if monitoring reveals that the expansion valve has been open during a longer time period. Furthermore, the opening degree may be reduced if monitoring reveals that the expansion valve has been closed during a longer time period, or if the expansion valve has been open during a short time period. Preselected threshold values for the duration of the opening and/or closing may be set in the controller.

The controller may operate using different control strategies. As an example, the control strategy during start-up may be to open the expansion valve fully, as described above. Subsequently, the expansion valve may be opened and closed based on the first and second temperature being determined.

A control strategy where the opening and closing of the expansion valve is carried out based on the difference between first and second temperatures as also described above may be relevant during an initialisation phase. During this phase the duration of opening and closing periods may be monitored.

After monitoring of the duration of the opening and closing periods, the control strategy may shift to an injection phase in which the controller may be adapted to control the expansion valve by changing the degree of opening of the valve based on the duration.

In one embodiment, the opening degree of the expansion valve may be increased, if the duration of the opening period in the injection phase is larger that the sum of the duration of the opening period and the duration of the closing period in the initialisation phase. Thus, the adjustment of the expansion valve may be expressed as the relationship between the duration of the opening period relative to the sum of the duration of the opening period and the duration of the closing period in the initialisation phase.

According to a second aspect, the invention provides a method for controlling an expansion valve of a vapour compression system for cooling a refrigerated space, the system comprising a circuit for circulation of a refrigerant between a compressor, a condenser, and the evaporator, the method comprising the steps of:

measuring a first temperature in the circuit between the evaporator and the compressor, determining a second air temperature in the refrigerated space, and controlling the expansion valve based on the first and second temperatures.

It should be understood, that a skilled person would readily recognise that any feature described in combination with the first aspect of the invention could also be combined with the second aspect of the invention, and vice versa.

The control system according to the first aspect of the invention is very suitable for performing the method steps according to the second aspect of the invention. The remarks set forth above in relation to the controller are therefore equally applicable in relation to the method.

According to a third aspect, the invention provides a vapour compression system for cooling a refrigerated space, the system comprising a circuit for circulation of a refrigerant between a compressor, a condenser, and an evaporator, the system further comprising an expansion valve for controlling a flow of the refrigerant into the evaporator and thereby cooling of the refrigerated space, and a control system according to the first aspect of the invention.

It should be understood, that a skilled person would readily recognise that any feature described in combination with the first and second aspects of the invention could also be combined with the third aspect of the invention, and vice versa.

BRIEF DESCRIPTION OF THE DRAWINGS

Embodiments of the invention will now be further described with reference to the drawings, in which.

DETAILED DESCRIPTION

It should be understood that the detailed description and specific examples, while indicating embodiments of the invention, are given by way of illustration only, since various changes and modifications within the spirit and scope of the invention will become apparent to those skilled in the art from this detailed description.

Figure 1:
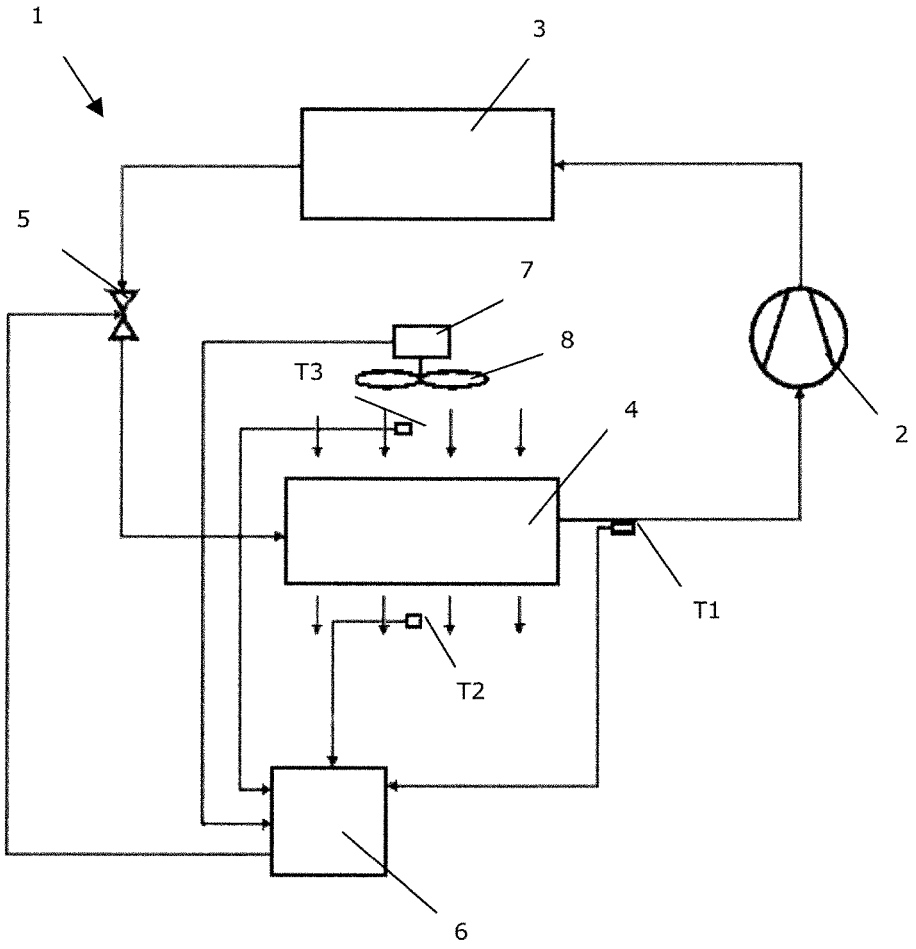
FIG. 1 illustrates a vapour compression system.

FIG. 1 illustrates a vapour compression system 1 for cooling a refrigerated space. The system 1 comprises a circuit for circulation of a refrigerant between a compressor 2, a condenser 3, and an evaporator 4. The system 1 further comprises an expansion valve 5 controlling a flow of the refrigerant into the evaporator and thereby cooling of the refrigerated space.

The system 1 comprises a controller 6 which is adapted to control the expansion valve 5 based on a first temperature T1 in the circuit between the evaporator 4 and the compressor 2 and a second air temperature T2 determined in the refrigerated space. The second temperature T2 may be measured in the refrigerated space.

However, as an alternative to measuring T2 directly, the controller 6 may be adapted to estimate the second temperature T2 based on a temperature difference between a third air temperature T3 and a preselected offset value. The third temperature T3 can be measured in a stream of air before the evaporator 4, and the preselected offset value can be set in the controller 6.

As illustrated in FIG. 1, the system 1 may further incorporate a motor 7 and a fan 8.

Figure 2:
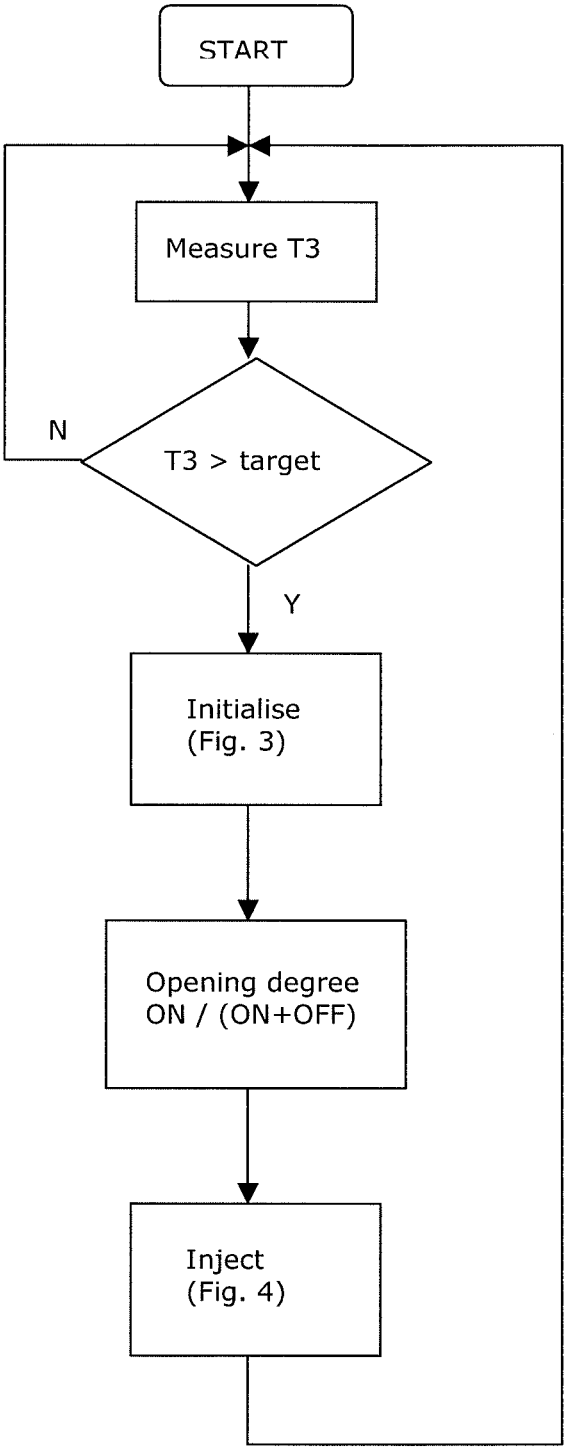
FIG. 2 illustrates a part of the control method during a start-up phase.
Figure 3:
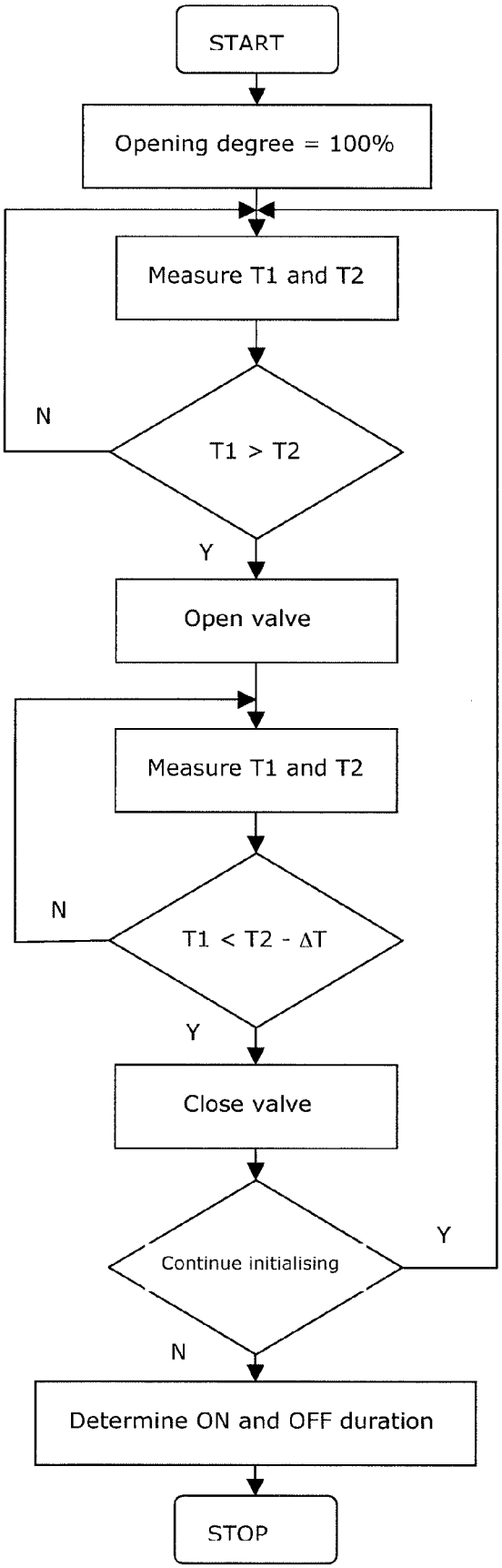
FIG. 3 illustrates a part of the control method during an initialisation phase.
Figure 4:
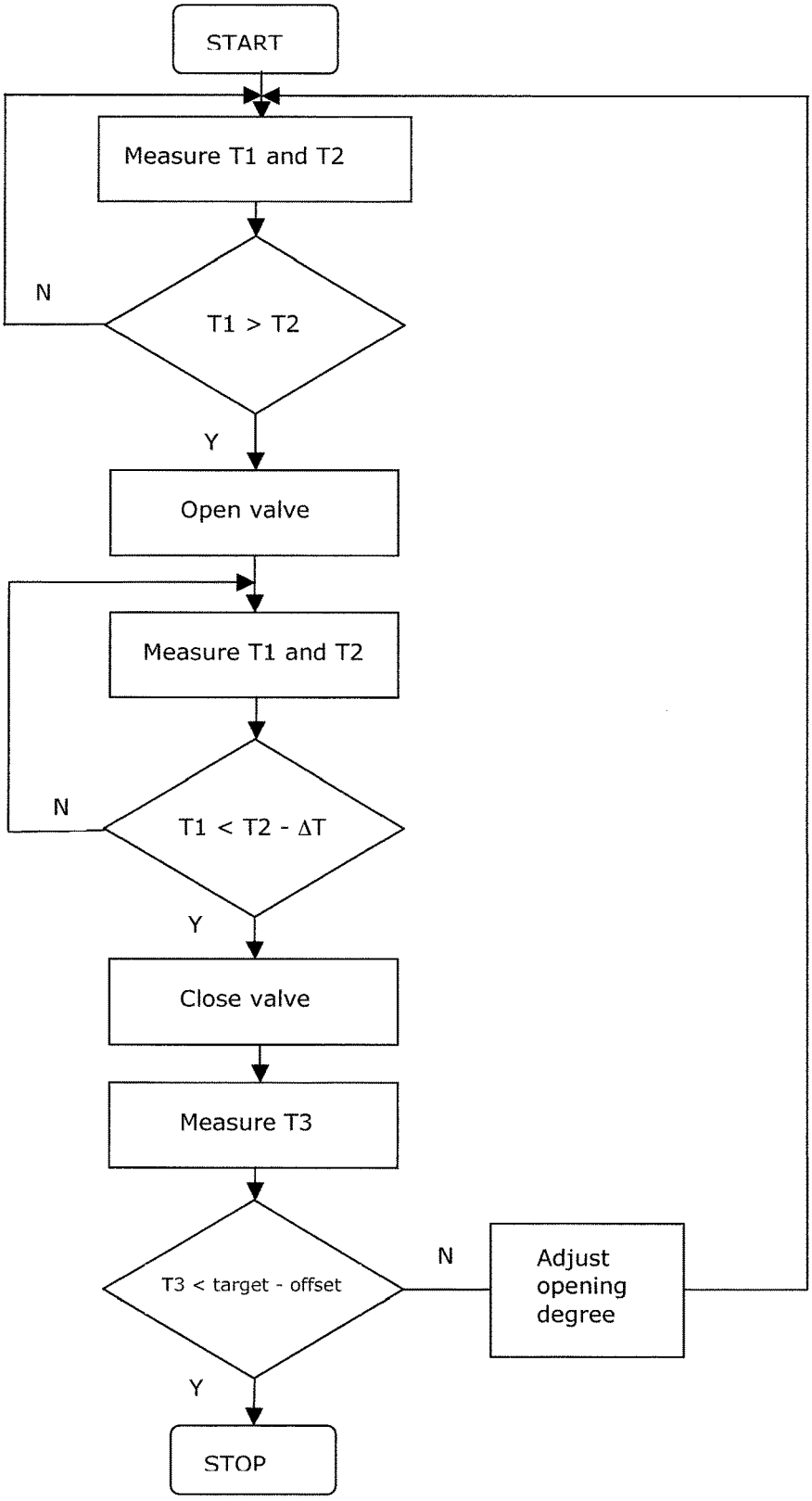
FIG. 4 illustrates a part of the control method during an injection phase.

FIGS. 2-4 illustrate different phases of the method of controlling the expansion valve 5 of a vapour compression system 1 for cooling a refrigerated space.

The controller of the system is adapted to control the expansion valve based on a first temperature T1 in the circuit between the evaporator and the compressor and a second air temperature T2 determined in the refrigerated space.

FIG. 2 illustrates an embodiment of the start-up phase. In the illustrated embodiment, a third temperature T3 is initially measured. The third temperature T3 is measured in the refrigerated space in a stream of air before the evaporator. Subsequently, this temperature is compared to a preselected target temperature for the refrigerated space.

If the third temperature T3 is above the target temperature, as indicated by Y (yes), the initialisation phase may be started (see FIG. 3 for details) by fully opening the expansion valve. Subsequently, the expansion valve may be opened and closed based on the first and second temperature being determined, and the opening degree may be monitored. If the third temperature T3 is not above the target temperature, as indicated by N (no), the opening degree of the expansion valve will not be changed, and the third temperature T3 will be measured again after a preselected time period.

After monitoring of the duration of the opening and closing periods, and calculating the opening degree of the expansion valve, the control strategy may shift to an injection phase in which the controller may be adapted to control the expansion valve by changing the degree of opening of the valve based on the duration (see FIG. 4 for details).

FIG. 3 illustrates an embodiment of the initialisation phase, in which the opening degree of the expansion valve is initially set to 100%. The first and second temperatures are determined by measuring the first temperature T1 between the evaporator and the compressor, and by determining the second air temperature T2 in the refrigerated space.

If the first temperature T1 is higher than the second temperature T2, as indicated by the Y, the expansion valve is opened, and the first and second temperatures are measured again.

If the first temperature T1 is below the second temperature T2 minus a preselected closing value, as indicated by the N, the valve is closed. If not (N), the first and second temperatures are measured at preselected intervals.

Thus, the expansion valve is controlled by use of a control strategy, in which opening and closing of the expansion valve is carried out based on the difference between first and second temperatures. During this phase the duration of opening and closing periods is monitored.

FIG. 4 illustrates an embodiment of the injection phase which is applied after the initialisation phase where the duration of the opening and closing periods is monitored.

The control strategy applied in the injection phase in allows the controller to control the expansion valve by changing the degree of opening of the valve based on the monitored duration.

As an example, the opening degree of the expansion valve may be increased, if the duration of the opening period in the injection phase is larger that the sum of the duration of the opening period and the duration of the closing period in the initialisation phase (see FIG. 2). Thus, the adjustment of the expansion valve may be expressed as the relationship between the duration of the opening period relative to the sum of the duration of the opening period and the duration of the closing period in the initialisation phase.

Furthermore, the opening degree may be adjusted, if the third temperature T3 is not (N) below the difference between a preselected target temperature and a preselected offset, as indicated at the bottom of FIG. 4. The check for the third temperature T3 may however run in parallel and thus independent of the control strategy based on the measurement and/or determination of the first and second temperatures T1, T2, whereby the adjustment of the opening degree may be performed subsequent to the closing of the valve. In parallel hereto, the valve may be closed based on the check for the third temperature T3.

Figure 5:
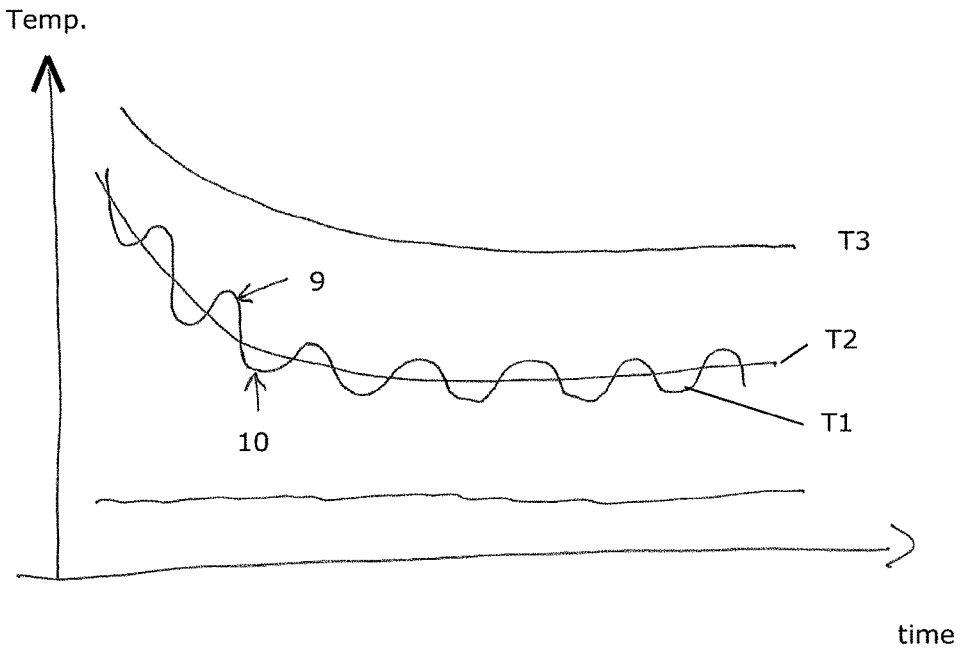
FIG. 5 illustrates temperature changes during control.

FIG. 5 illustrates an example of temperature changes during control. The upper temperature curve T3 illustrates the air temperature measured in the refrigerated space in a stream of air before the evaporator. T1 is the first temperature determined between the evaporator and the compressor. T2 is the second air temperature which is determined in the refrigerated space. In the present embodiment, T2 is the temperature of the second medium after having passed the evaporator, where heat is exchanged with the refrigerant.

The controller is adapted to control the expansion valve in order to obtain a selected target temperature in the refrigerated space. In the present embodiment, the controller is adapted to control the valve based on a difference between the first temperature T1 and second temperature T2.

To lower the first temperature T1 the expansion valve will have to be opened, and in order to achieve this, the controller is adapted to open the valve, if the first temperature is higher than the second temperature. Opening of the expansion valve is carried out as each of the crests 9 of the curve illustrating the first temperature T1.

In order to avoid that the expansion valve is continuously opened and closed at very short intervals, the controller is adapted to close the valve, if a difference between the first temperature T1 and second temperature T2 is above a predefined closing value ΔT. The predefined closing value may be seen as a hysteresis ensuring that the expansion valve is not continuously opened and closed at very short intervals. Closing of the expansion valve is carried out as each of the troughs 10 of the curve illustrating the first temperature T1.

Although various embodiments of the present invention have been described and shown, the invention is not restricted thereto, but may also be embodied in other ways within the scope of the subject-matter defined in the following claims.

What is claimed is:

1. A controller for a vapour compression system for cooling a refrigerated space, the system comprising a circuit for circulation of a refrigerant between a compressor, a condenser, and an evaporator, and an expansion valve controlling a flow of the refrigerant into the evaporator and thereby cooling of the refrigerated space, wherein the controller is adapted to control the expansion valve to cool the refrigerated space based on a first temperature in the circuit after the evaporator and before the compressor and a second air temperature determined in the refrigerated space, the second air temperature being a temperature of a medium after passing the evaporator where heat is exchanged with the refrigerant, wherein the controller is adapted to control the valve to cool the refrigerated space based on a difference between the first and second temperatures, and wherein the controller is configured to open the valve if the rate of change, Roc, of both the first and second temperatures is positive, and the first temperature is higher than a previously measured the first temperature plus a predefined opening constant.

2. A controller for a vapour compression system for cooling a refrigerated space, the system comprising a circuit for circulation of a refrigerant between a compressor, a condenser, and an evaporator, and an expansion valve controlling a flow of the refrigerant into the evaporator and thereby cooling of the refrigerated space, wherein the controller is adapted to control the expansion valve to cool the refrigerated space based on a first temperature in the circuit after the evaporator and before the compressor and a second air temperature determined in the refrigerated space, the second air temperature being a temperature of a medium after passing the evaporator where heat is exchanged with the refrigerant, wherein the controller is adapted to control the valve to cool the refrigerated space based on a difference between the first and second temperatures, and wherein the controller is configured to close the valve if the rate of change, Roc, of both the first and second temperatures is negative and the first temperature is lower than the second temperature minus a predefined closing constant.

3. The controller according to claim 1, wherein the controller is adapted to determine a duration in which the valve is open, and wherein the controller is adapted to change a degree of opening of the valve based on the duration.

4. The controller according to claim 1, wherein the controller is adapted to initialise control of the expansion valve based on an air temperature determined in the refrigerated space.

5. The controller according to claim 1, wherein the controller is adapted to estimate the second temperature based on a temperature difference between a third air temperature and a preselected offset value, where the third temperature is measured in a stream of air before the evaporator.

6. A method for controlling an expansion valve of a vapour compression system for cooling a refrigerated space, the system comprising a circuit for circulation of a refrigerant between a compressor, a condenser, and the evaporator, the method comprising the steps of:

measuring a first temperature in the circuit after the evaporator and before the compressor, determining a second air temperature in the refrigerated space, the second air temperature being a temperature of a medium after passing the evaporator where heat is exchanged with the refrigerant, and controlling the expansion valve based on the first and second temperatures to cool the refrigerated space, wherein the expansion valve is controlled to cool the refrigerated space based on a temperature difference between the first and second temperatures, and wherein the controller is configured to open the valve if the rate of change, Roc, of both the first and second temperatures is positive, and the first temperature is higher than a previously measured the first temperature plus a predefined opening constant.

7. The method according to claim 6, wherein control of the expansion valve is initialised based on an air temperature determined in the refrigerated space.

8. The method according to claim 6, wherein the second temperature is estimated as the temperature difference between a third air temperature and a preselected offset value, where the third temperature is measured in a stream of air before the evaporator.

9. The method according to claim 6, further comprising a step of determining a duration in which the valve is open, and controlling a degree of opening of the valve based on the duration.

10. A vapour compression system for cooling a refrigerated space, the system comprising:

a circuit for circulating a refrigerant between a compressor, a condenser, and an evaporator;

an expansion valve for controlling a flow of the refrigerant into the evaporator to cool the refrigerated space; and a controller for controlling the expansion valve to cool the refrigerated space based on a first temperature in the circuit after the evaporator and before the compressor and a second air temperature determined in the refrigerated space, the second air temperature being a temperature of a medium after passing the evaporator where heat is exchanged with the refrigerant;

wherein the controller is adapted to control the valve to cool the refrigerated space based on a difference between the first and second temperatures, and wherein the controller is configured to open the valve if the rate of change, Roc, of both the first and second temperatures is positive, and the first temperature is higher than a previously measured the first temperature plus a predefined opening constant.

* * * * *